US007896037B2

(12) United States Patent
Alsberg et al.

(10) Patent No.: US 7,896,037 B2
(45) Date of Patent: Mar. 1, 2011

(54) WATER COOLER CADDY

(75) Inventors: Keith D. Alsberg, Chicago, IL (US); Mikael Bäckström, Chicago, IL (US); Matthew A. Cowen, Chicago, IL (US)

(73) Assignee: Square 1 Product Development, Inc., Chicago, IL (US)

( * ) Notice: Subject to any disclaimer, the term of this patent is extended or adjusted under 35 U.S.C. 154(b) by 727 days.

(21) Appl. No.: 11/356,937

(22) Filed: Feb. 17, 2006

(65) Prior Publication Data

US 2007/0062602 A1 Mar. 22, 2007

Related U.S. Application Data

(60) Provisional application No. 60/595,908, filed on Aug. 16, 2005.

(51) Int. Cl.
*B67C 3/02* (2006.01)
*B67D 7/78* (2010.01)

(52) U.S. Cl. ..... 141/98; 141/174; 220/500; 222/130

(58) Field of Classification Search ..... 141/98, 141/174; 211/49.1; 222/130; 220/23.4, 220/500

See application file for complete search history.

(56) References Cited

U.S. PATENT DOCUMENTS 1,778,248 A * 10/1930 Doughty ..... 222/132
3,262,596 A * 7/1966 Zillmann ..... 215/390
3,788,487 A * 1/1974 Dawson ..... 211/49.1
D247,940 S * 5/1978 Tobin ..... D6/542
4,323,172 A * 4/1982 Lim ..... 222/130
4,826,007 A * 5/1989 Skeie ..... 206/373
4,895,418 A * 1/1990 Medellin et al. ..... 312/249.7
5,301,833 A * 4/1994 Aycan ..... 221/96
5,303,500 A * 4/1994 Luukonen ..... 43/54.1
5,372,827 A 12/1994 Brauner et al.
5,971,200 A * 10/1999 Reynolds ..... 220/694
5,984,131 A * 11/1999 Krueger et al. ..... 220/574
6,866,166 B2 * 3/2005 Mehes et al. ..... 222/192

FOREIGN PATENT DOCUMENTS

DE 1 586 701 7/1971
GB 2 264 921 A 9/1993
GB 2 357 073 A 6/2001
WO WO 96/00178 1/1996

OTHER PUBLICATIONS

International Search Report dated Dec. 11, 2006.

* cited by examiner

*Primary Examiner*—Timothy L Maust
(74) *Attorney, Agent, or Firm*—Brinks Hofer Gilson & Lione

(57) ABSTRACT

A water cooler caddy device for use in conjunction with a water cooler or other beverage dispenser. The water cooler caddy has an arcuate inner surface as an interface with the water bottle and is sized such that it may be placed over the water bottle and slid down so that it either rests on an upper surface of the water cooler, or is supported by the side of the water bottle. The water cooler caddy may have a gap in the circumference so that the radius of the inner surface may be temporarily increased to facilitate installation. Partitions are used to form compartments to contain service items.

28 Claims, 12 Drawing Sheets

WATER COOLER CADDY

This application claims the benefit of priority to U.S. provisional application No. 60/595,908 which was filed on Aug. 16, 2005 and is incorporated herein by reference.

TECHNICAL FIELD

This application relates to a device for use in conjunction with a water cooler, and more particularly to a device which is mountable to the water cooler for storing objects or materials for convenient use.

BACKGROUND

Water coolers are used in the home and office to dispense bottled water. The water is usually contained in a bottle mounted in an inverted position, and may be dispensed as cooled water or heated water, or both. A user of the water cooler may wish to make a hot or cold drink using the dispensed water, and performing such an act may require a liquid container, the dispensed water, ingredients to be mixed with the water, mixing or stirring implements, and container caps, as examples.

SUMMARY

A water cooler caddy or storage device is disclosed. The device is configured so as to be positionable around the circumference of a water bottle such that the device can be placed in position either before or after the water bottle is mounted to the water cooler. Further, the device is dimensioned so that it may slide down from the top of the installed water bottle and rest on a surface of the water cooler, or be deformed such that the device may be associated with the water bottle by deforming the device structure so that an opening greater than the diameter of the water bottle is temporarily formed. Alternatively, the device is dimensioned such that an interference fit between the water bottle and a device surface supports the device at a position intermediate between the top and bottom of the water bottle. For a device with fixed dimensions, the interference or sliding fit may be dependent on the dimensions of the water bottle.

In an aspect, the device is an annular ring, and the ring may have a gap extending vertically, either partially or fully across the height dimension. In conjunction with the flexibility of the material used to fabricate the ring, the ring may be pulled away from contact with the water bottle, by increasing the effective diameter of the ring, so as to facilitate removing the ring from the bottle. In this state, the ring may be conveniently lifted vertically to disengage the ring from the bottle. Alternatively, the gap may be sufficiently large such that the water cooler caddy may be installed from the front of the water cooler by temporarily spreading the gap and the gap then positioned with respect to the front of the water cooler. Handles may be provided on the ring so as to permit a person to grip the ring for installation or removal, or other projections from the ring may serve the same purpose.

The ring may be divided into receptacles or containers for holding various items of utility to the user of the water cooler by either partitions extending between the inner and outer walls of the annular ring, or by trays or receptacles dimensioned to be inserted between the inner and outer walls of the annular ring.

Compartments may appended to the ring so as to provide storage for various items, which may include, but are not limited to beverage mixing supplies and materials (such as bottles or jars of drink mixes, prepackaged individual powdered beverage servings, single serving packages of sugar, creamer and the like, lids for cups, stirrers, napkins and the like.) A work shelf may be provided to support a beverage container or supplies while accessing or using any of the items stored in the water cooler caddy. A conical hole may be provided to support disposable conical cups that are used with many water coolers.

The water cooler caddy may be provided with additional storage areas or accessories by providing mounting attachment points such that holders for trash bags, paper towels, extra beverage support shelves, powdered or liquid material dispensers may be added as desired for a specific installation.

DETAILED DESCRIPTION

Exemplary embodiments may be better understood with reference to the drawings, but these embodiments are not intended to be of a limiting nature. Like numbered elements in the same or different drawings perform equivalent functions. When a specific feature, structure, or characteristic is described in connection with an example, it will be understood that a person skilled in the art may employ such a feature, structure, or characteristic in connection with the other examples, whether or not explicitly stated herein.

Figure 1:
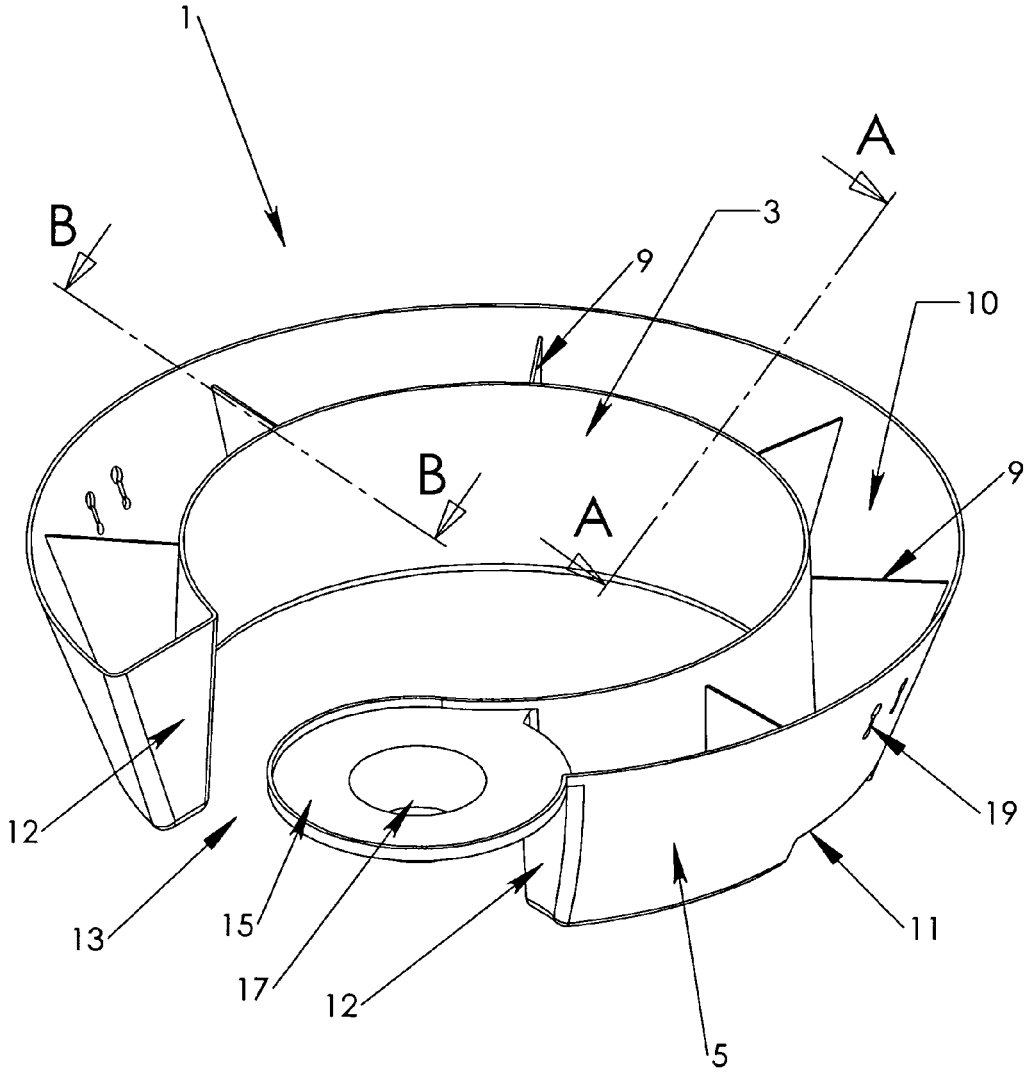
FIG. 1 is a perspective view of an example of a water cooler caddy.

In an example shown in FIG. 1, a water cooler caddy 1 includes a generally annular shaped ring having a trough-like cross section 8. An inner surface 3 of the water cooler caddy 1 is sized and dimensioned such that a radius of curvature of the inner surface 3 with respect to a central point is approximately equal to that of a water bottle 23, the water bottle being intended for use in a water cooler 21, (see FIG. 2) to which it may be applied. The radius of the inner surface 3 may be less than the radius of the water bottle 23, in which situation the water cooler caddy 1 will grip the surface of the water bottle 23 when the water cooler caddy 1 is placed in operating position. The radius of the inner surface 3 may be greater than the radius of the water bottle 23, in which situation the water cooler caddy 1 will slidable with respect to the water bottle 23, and the lower portion of the trough-like structure 8 may rest on a surface 25 of a water cooler 21 when the water cooler caddy 23 is placed in an installed position. In the situation where the radius of the inner surface 3 is essentially equal to the radius of the water bottle 23 the water cooler caddy 1 may either be supported by gripping the surface of the water bottle 23 or rest on the water cooler 21, depending on such factors as the weight of the water caddy 1, the coefficient of friction between the water caddy inner wall 3 and the water bottle 23, and any deformations of the surface of the water bottle 23, whether intentional (such as ribs) or unintentional (such as manufacturing tolerances). The resistance of the water cooler caddy 1 to rotating with respect to the water bottle 23 may thus vary, and may be a design consideration.

Figure 2:
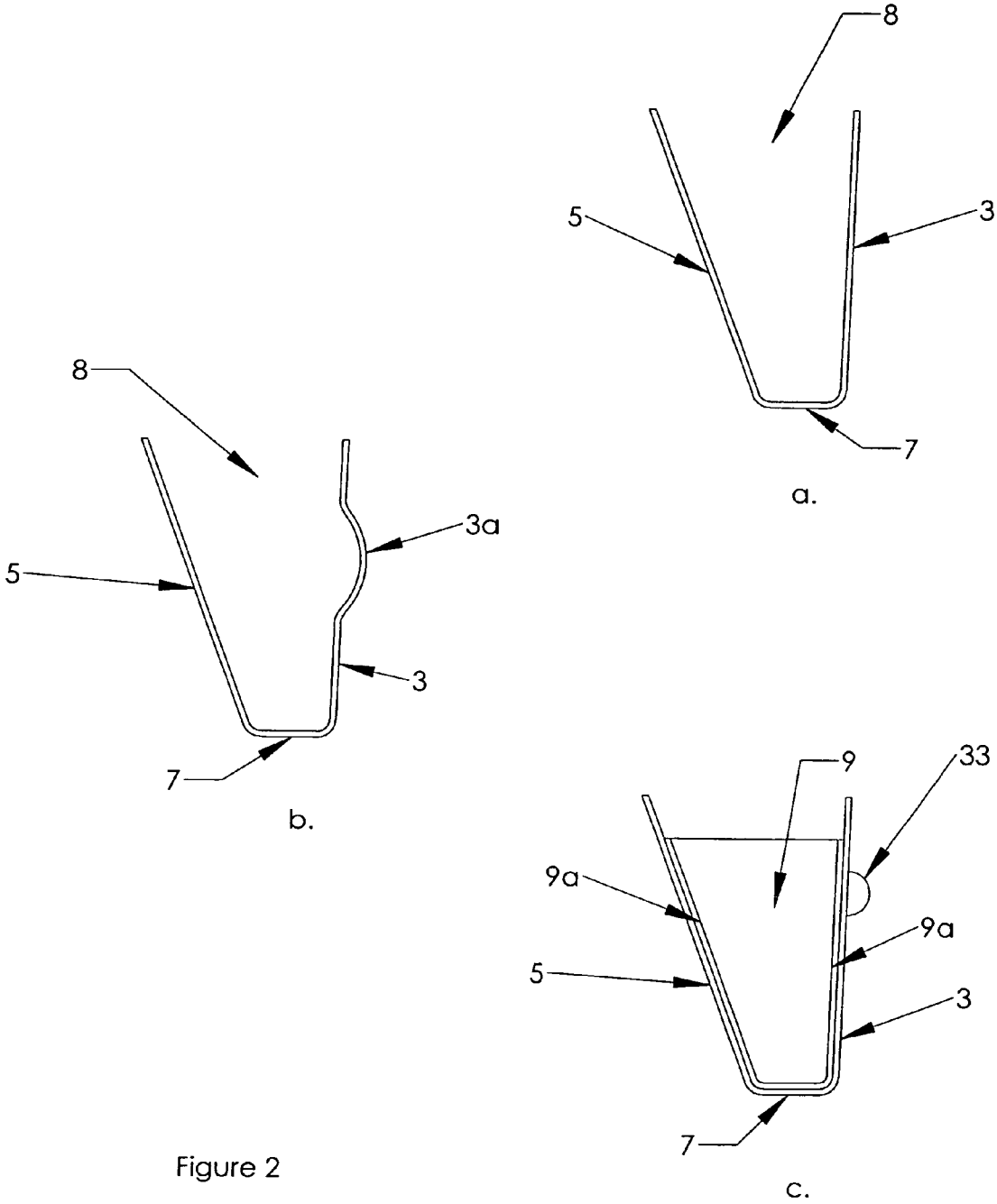
FIG. 2 is a cross-sectional view of FIG. 1 showing several alternative cross sections; (a) at section A-A; (b) at A-A showing a protuberance; and (c) at section B-B showing a partition.

In cross-section, the annular ring has a trough-like configuration 8, as shown in FIG. 2*a*, representing a cross-section of the water cooler caddy 1 at line A-A. An inner surface 3, an outer surface 5, and a bottom surface 7 serve to retain objects place inside of the trough-like structure 8. The individual surfaces are shown as having distinct boundaries in FIG. 2*a* where the surfaces join to one another; however, as shown in FIG. 2*b*, the joining region between the inner surface 3, the outer surface 5 and the bottom surface 7 may be substantially curved (not shown). The absence of corners in the joining region may facilitate cleaning the device. Further, the inner surface 3 may be deformed in a manner 3*a* which limits the contact area between the inner surface 3 and the water bottle 23, so as to control the force needed either to install the water cooler caddy 1 or to rotate the water cooler caddy 1 with respect to the water bottle 23. The trough shapes 8 shown in FIG. 2 are examples of shapes which may be used, and other shapes will be apparent to persons skilled in the art.

At intervals along the length of the trough 8, partitions 9 are disposed so as to divide the trough 8 into annular segments, receptacles, or compartments 10. Each compartment 10, being a region defined by partitions 9, and the inner 3, outer 5 and bottom 7 surfaces, may be dimensioned to hold a plurality of single-use materials and objects such as individual packages of sugar, stirrers and the like. A gap 13 is formed in the ring, and the ends of the trough 8 facing the gap 13 are closed by a surface 12, which also acts as a partition to form a portion of the compartment 10 adjacent to the gap 13.

In FIG. 1, the partitions 9 are shown as integrally formed with the inner 3, outer 5 and bottom 7 surfaces; however, as shown in FIG. 2*c*, at least the inner 3 and outer 5 surfaces may be provided with grooves 9*a*, disposed such that a partition 9 may be inserted at a variable spacing along the arcuate trough 8 by providing a plurality of grooves 9*a* at spacings along the trough 8 The grooves 9*a* may extend inward from an inner surface of the inner 3 and outer 5 surfaces of the water cooler caddy 1 towards the compartment 10, as shown, or be recessed into the inner surfaces. The heights of the partitions 9 may vary, depending on the type and size of the materials to be deposited into the compartment 10.

The water cooler caddy may be fabricated from a variety of engineering materials, which may include metal or plastic. Plastic may be injection molded to form all or part of the water caddy including the partitions. Alternatively, the partitions and the remainder of the water cooler caddy may be fabricated from different materials.

Figure 5:
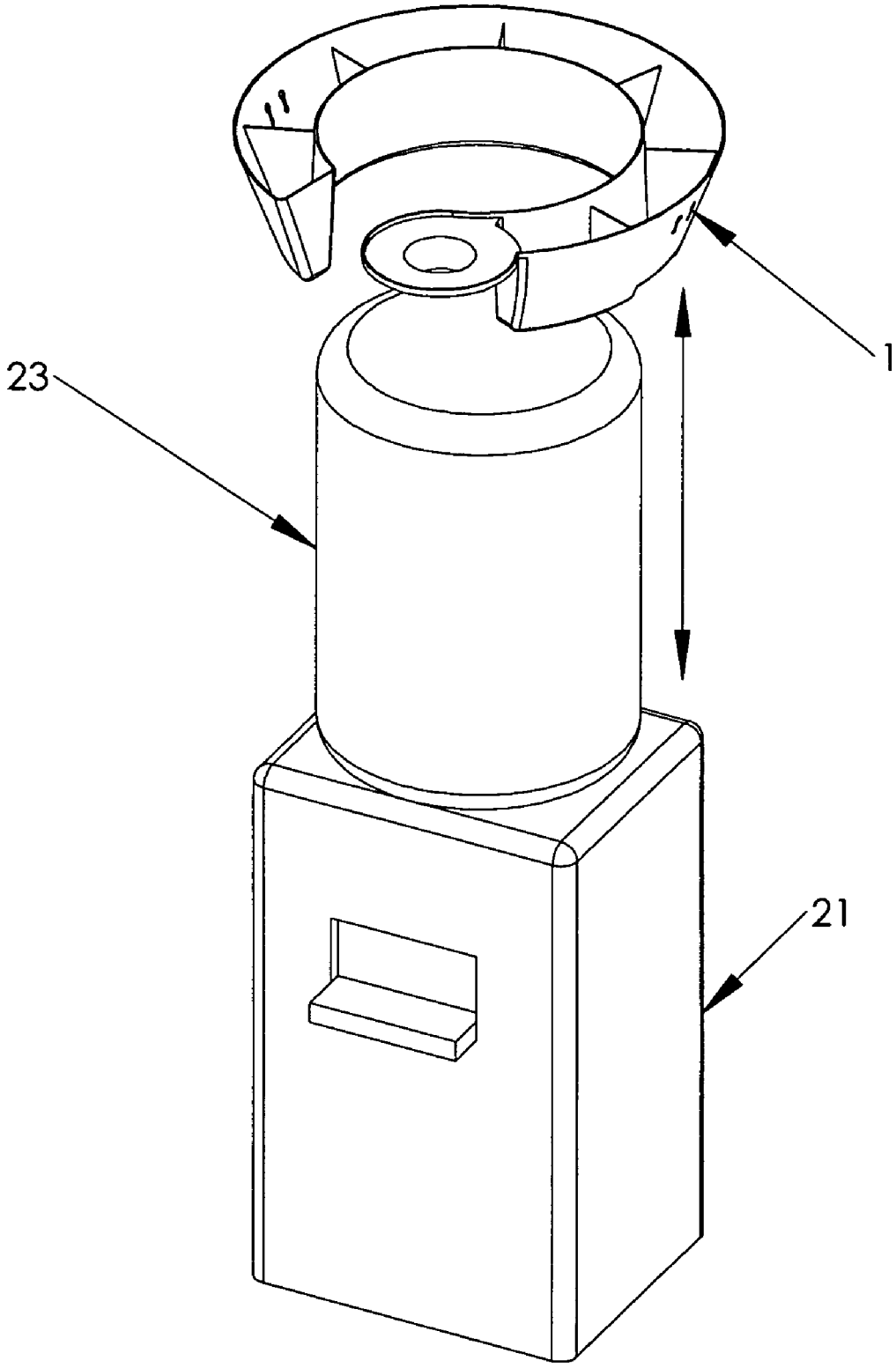
FIG. 5 is a perspective view illustrating a method of placing the water cooler caddy on the water cooler.
Figure 8:
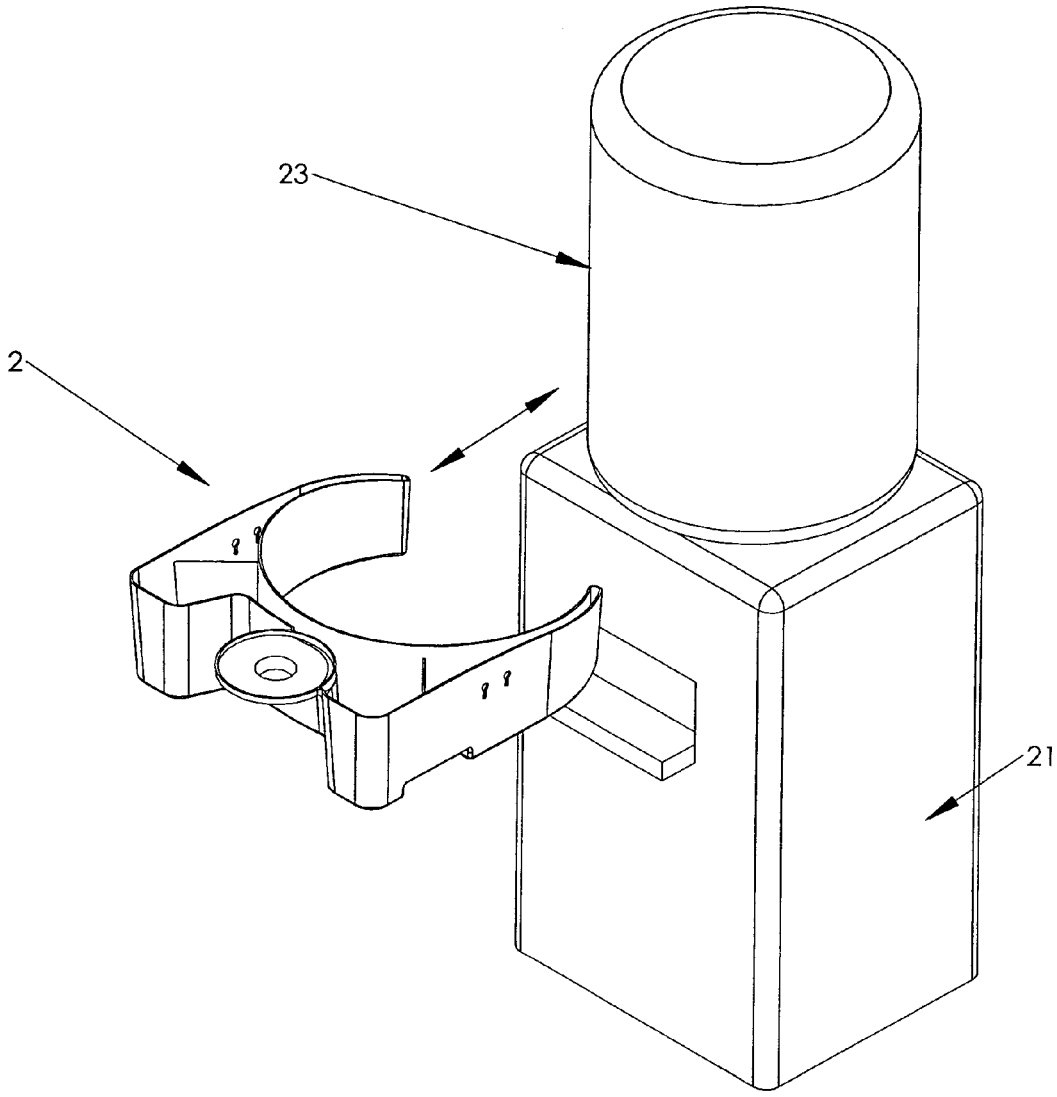
FIG. 8 is a perspective view illustrating a method of placing the water cooler caddy on the water cooler

Handles 11 may be provided to assist in placing the water cooler caddy 1 on the water cooler 21. The handles 11 may be disposed so that they are part of the outer surface 5 of the water cooler caddy and disposed on either side of a gap 13. The handles 11 may be gripped and pulled apart so as to spread the gap 13 and permit the lowering of the water cooler caddy 1 over top of a water bottle 23 as shown in FIG. 5, so as to position the water cooler caddy 1 in an operational position on the water cooler 21. Alternatively, the gap 13 may be sufficiently wide, and the material forming the water cooler caddy 1 be sufficiently flexible so that the gap 13 may be spread by pulling on the handles 11 so as to permit the water cooler caddy 1 to be installed by moving it in a horizontal manner with respect to the water bottle 23 (see FIG. 8).

In an aspect, the water cooler caddy 1 may be provided with a shelf 15. The shelf 15 may have a solid surface (not shown) so that a cup or other container may be placed thereon for convenience in using the water cooler and accessories, or have a hole 17 therein and shaped and dimensioned so as to secure one or more conical shaped or other cups for use with the water cooler.

In an aspect, a compressible material may be applied in a strip 33 to the inner surface 3, facing the water bottle 23 so as accommodate minor dimensional variations in the water bottle 23 or the water cooler caddy 1, and may also serve to control the force required to lower the water cooler caddy 1 into position; to control the force needed to rotate the water cooler caddy 1 with respect to the water bottle 23; and to hold the water cooler caddy 1 in position above the surface 25 of the water cooler 21. The compressible material, which may be a cellular foam, foam rubber or any resilient material, may be also disposed as short strips or patches 34. Either or both of the strip 33 and the patches 34 may be provided on the same water caddy 1, or may be omitted.

A pair of keyhole interfaces 19 is a means for mounting modules to the water cooler caddy 1. Sliding interfaces, clamping interfaces and other means of securing one object to another, depending on the physical attributes of the module and the desire for either temporary of permanent attachment will be apparent to persons skilled in the art. The modules may include cup dispensers, which have a generally cylindrical shape, bottle holders, and the like, and including other shaped containers which might hold stirrers or other objects.

Figure 3:
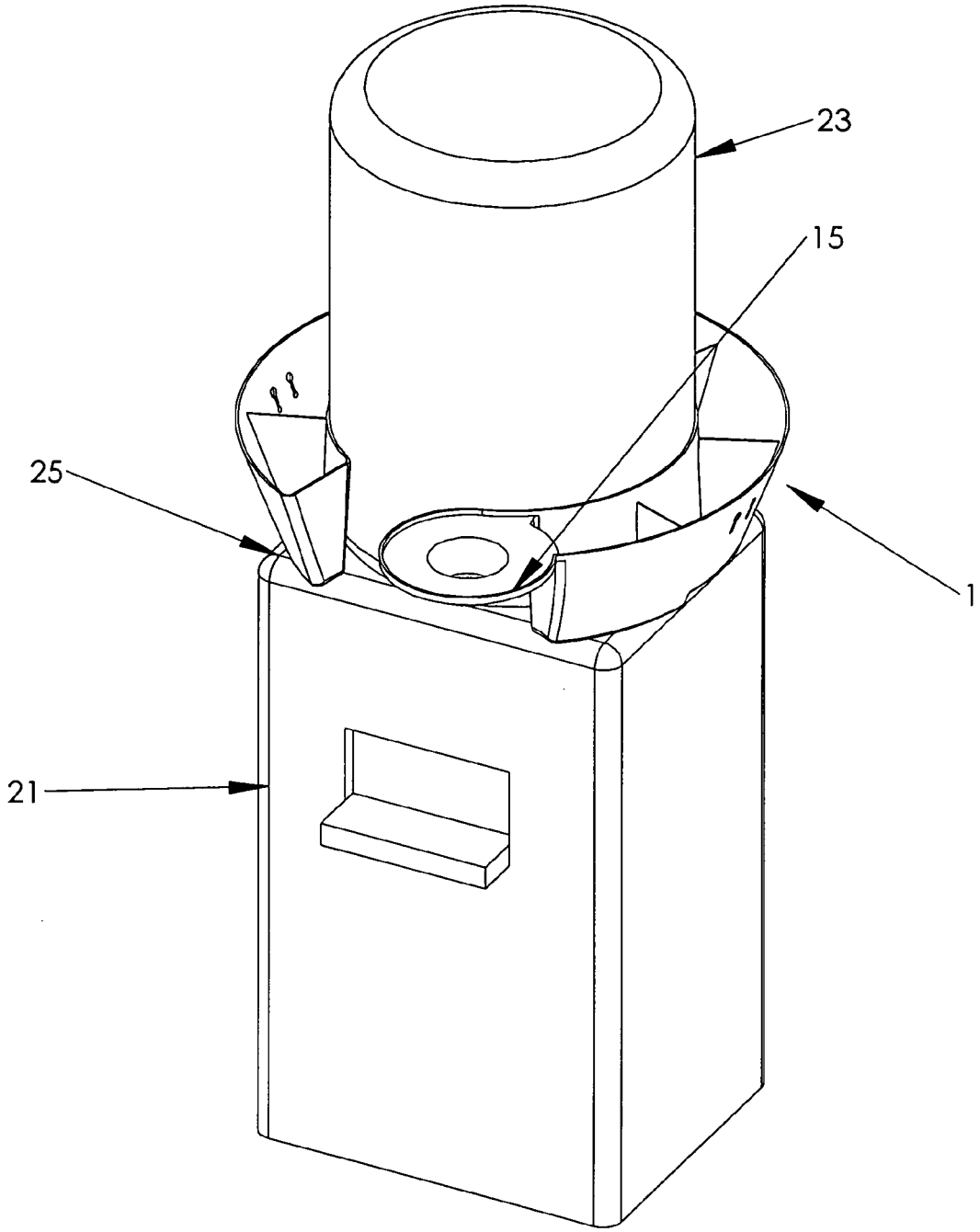
FIG. 3 is a perspective view of the water cooler caddy of FIG. 1 installed on a water cooler.
Figure 4:
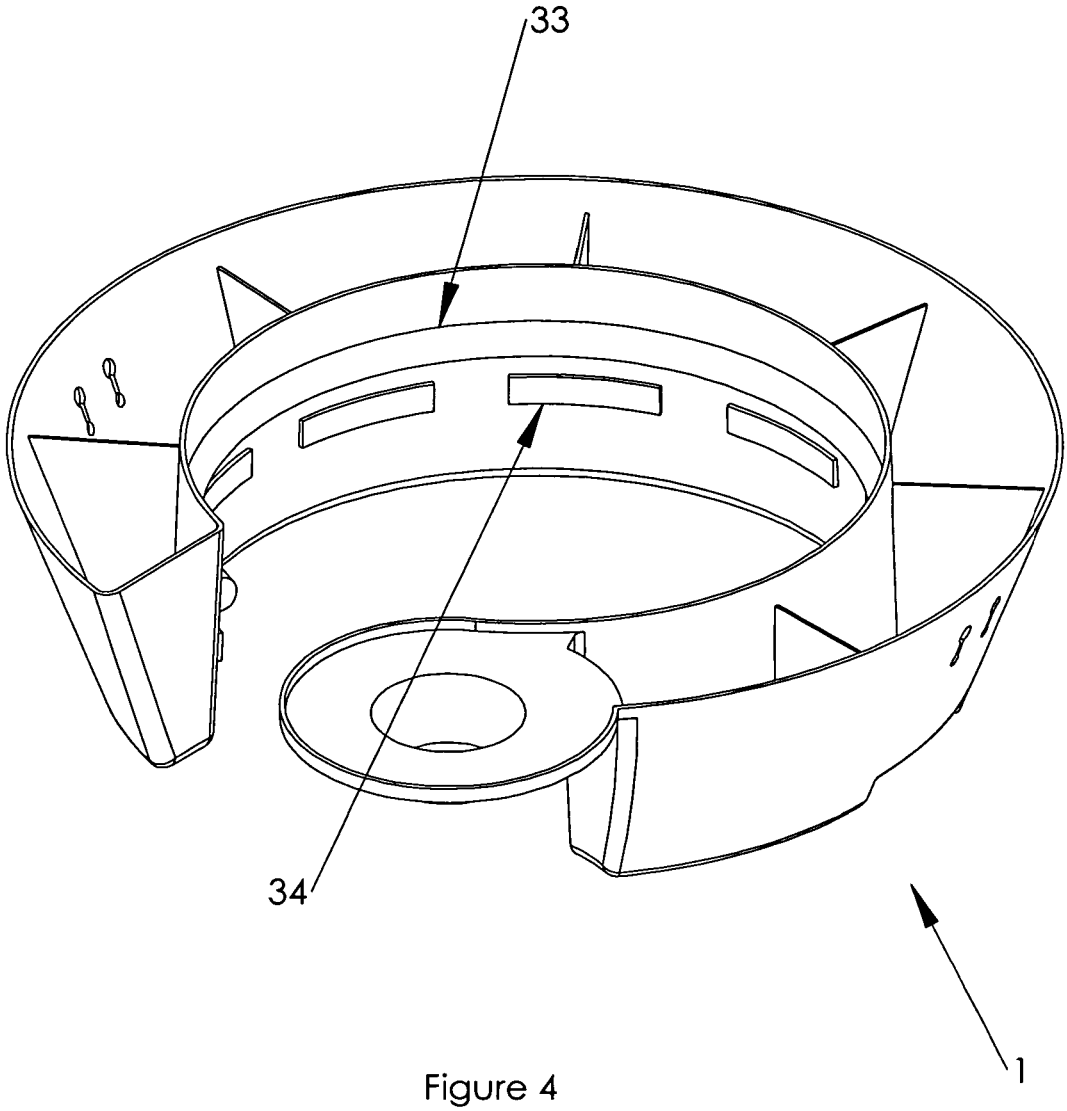
FIG. 4 is a perspective view of the water cooler caddy of FIG. 1 having a compressible interface.

FIG. 3 illustrates a water cooler caddy 1 such as that shown in FIG. 1, installed on a water cooler 21. In this example, the work shelf 15 is positioned generally in the front of the water cooler 21, but may be positioned to either side of the front depending on individual access requirements. FIG. 5 illustrates a method of installing the water cooler caddy 1 on a water cooler 21, in which the water cooler caddy 1 is raised so as to clear the top of the water bottle 23, and oriented such that the center of curvature of the inner surface 3 of the water cooler caddy 1 is approximately coaxial with the centroid of the water bottle 23. The water cooler caddy 1 may then be lowered into the position shown in FIG. 3. During the installation process, the handles 11 may be used to spread the gap 13, thus temporarily increasing the effective radius of curvature of the inner surface 3 so as to facilitate sliding the water cooler caddy 1 downward along the surface of the water bottle 23.

Figure 6:
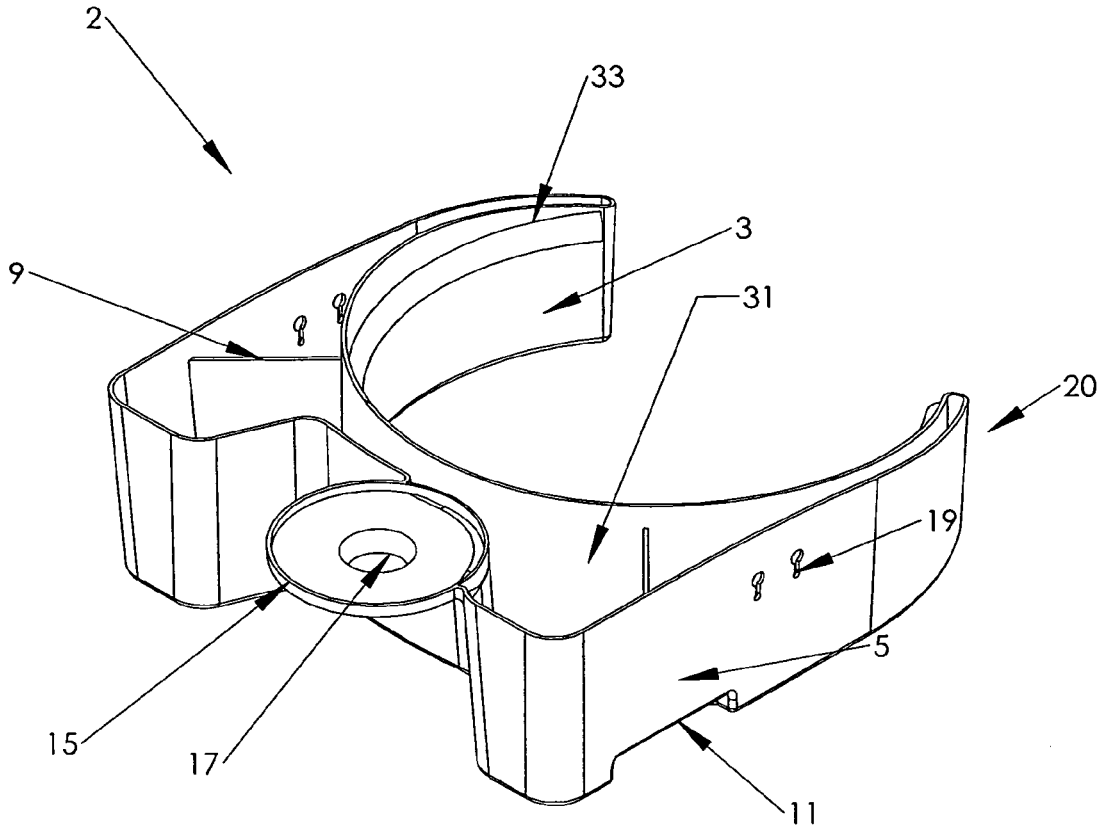
FIG. 6 is a perspective view of another example of a water cooler caddy.

In another example, shown in FIG. 6, the inner arcuate surface 3 of a water cooler caddy 2 is sized and dimensioned in a similar manner to that of example shown in FIG. 1; however the outer surface 5 may have a shape that does not conform to the cylindrical shape of the water bottle 23. The water cooler caddy 2 has an inner surface shape and dimension such that the water cooler caddy 2 either grips the water bottle 23, or permits the water cooler caddy 2 to be securely held in position with respect to the water bottle 23 while resting on an upper surface of a water cooler 21, or being fully supported by gripping the water bottle 23, the situation being dependent on the specific relationship of the radius of curvature of the inner surface 3 of the water cooler caddy 2 and of the water bottle 23.

The outer surface 5 of the water cooler caddy 2 may cooperate with a bottom surface 7 of the water cooler caddy 2 and the partitions 9 to form receptacles 31 of varying shapes to hold materials in a similar manner to that of the previous example.

Figure 7:
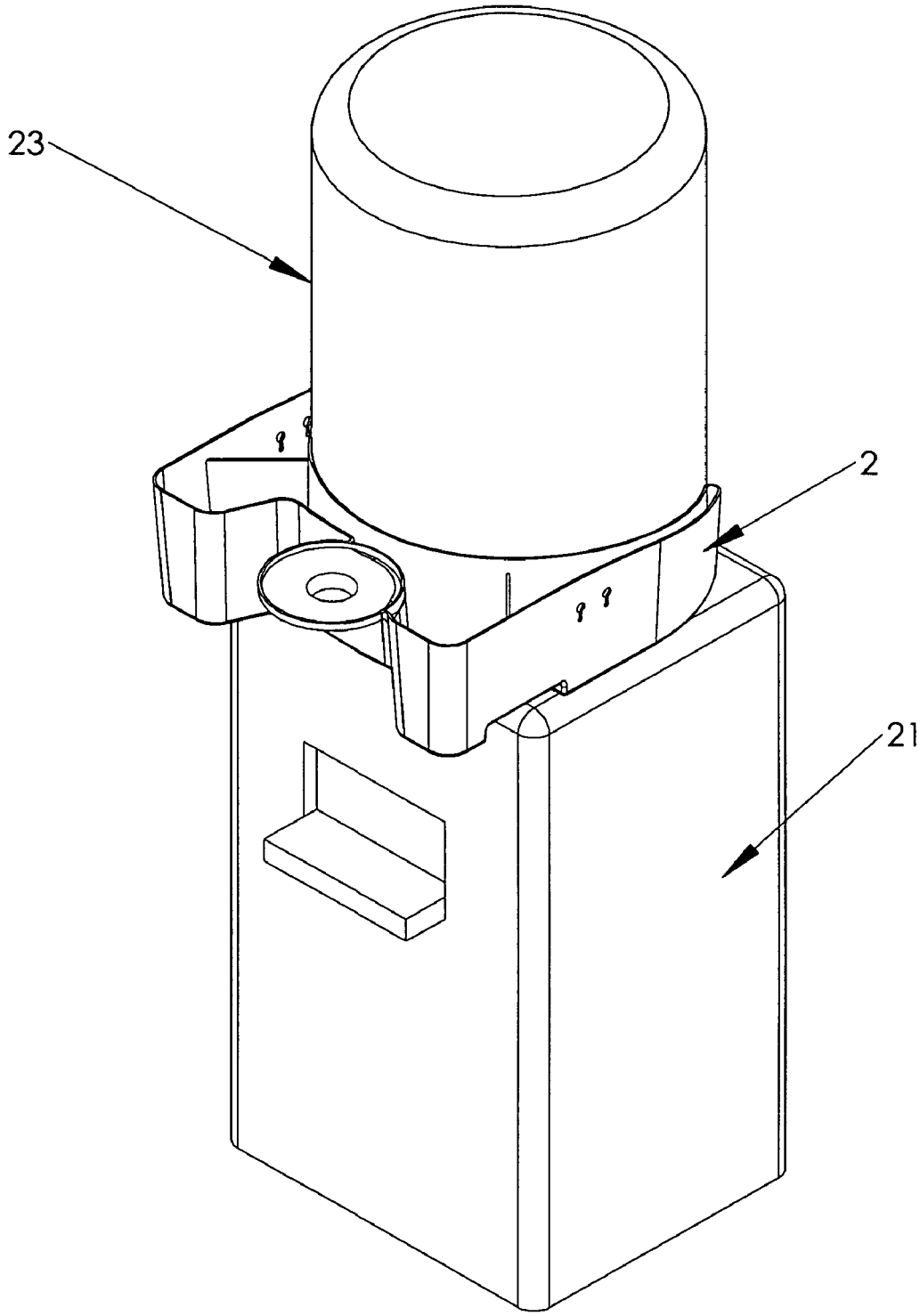
FIG. 7 is a perspective view of the water cooler caddy of FIG. 6 installed on a water cooler.

FIG. 7 shows the water cooler caddy 2 in an operating position on a water cooler 21. The method of installation may correspond to that previously described with respect to FIG. 5. In an alternative, shown in FIG. 8, the handles 11 may be pulled in opposite directions such that the distance D between opposing sides of the gap 13 is greater than the diameter of the water bottle 23, such that the water cooler caddy 2 may be mated with the water bottle 23 near the base thereof, without raising the water cooler caddy 2 above the top of the water bottle 23. This method of installation may also be used for the water cooler caddy 1 shown in FIG. 1

In another aspect, the inner wall 3 may extend further in a vertical direction than the outer wall 5 so that a surface for display of messages, logos or other information is provided.

In yet another aspect, either the water cooler 21 or the water cooler caddy are fitted with attachment points so that once the water cooler caddy is installed, the water cooler caddy can remain in place when the water bottle 23 is being replaced.

In still another aspect, removable storage bins having arcuate sides, with ends similar to the partitions 9, and a bottom similar to the trough bottom 7, and dimensioned so as to be insertable into the trough-like structure 8 may be used in place of one or more partitions 9 in order to provide for removable compartments or receptacles.

Figure 9:
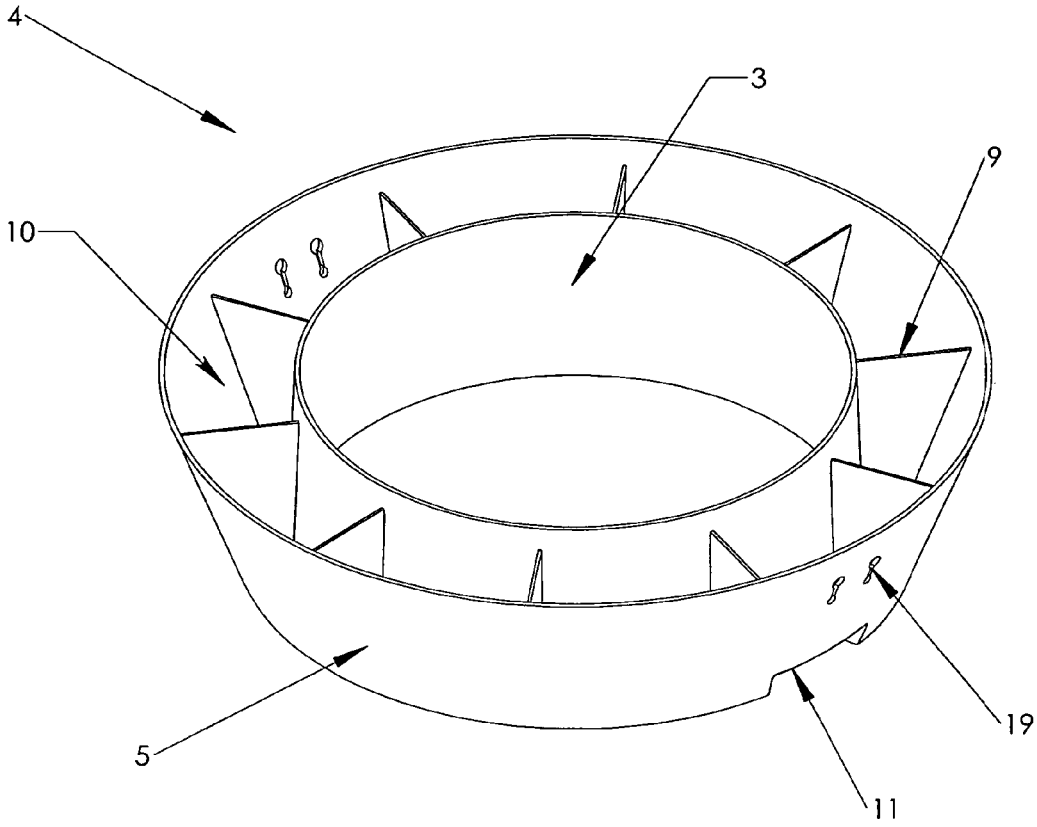
FIG. 9 is a perspective view of yet another example of a water cooler caddy.
Figure 10:
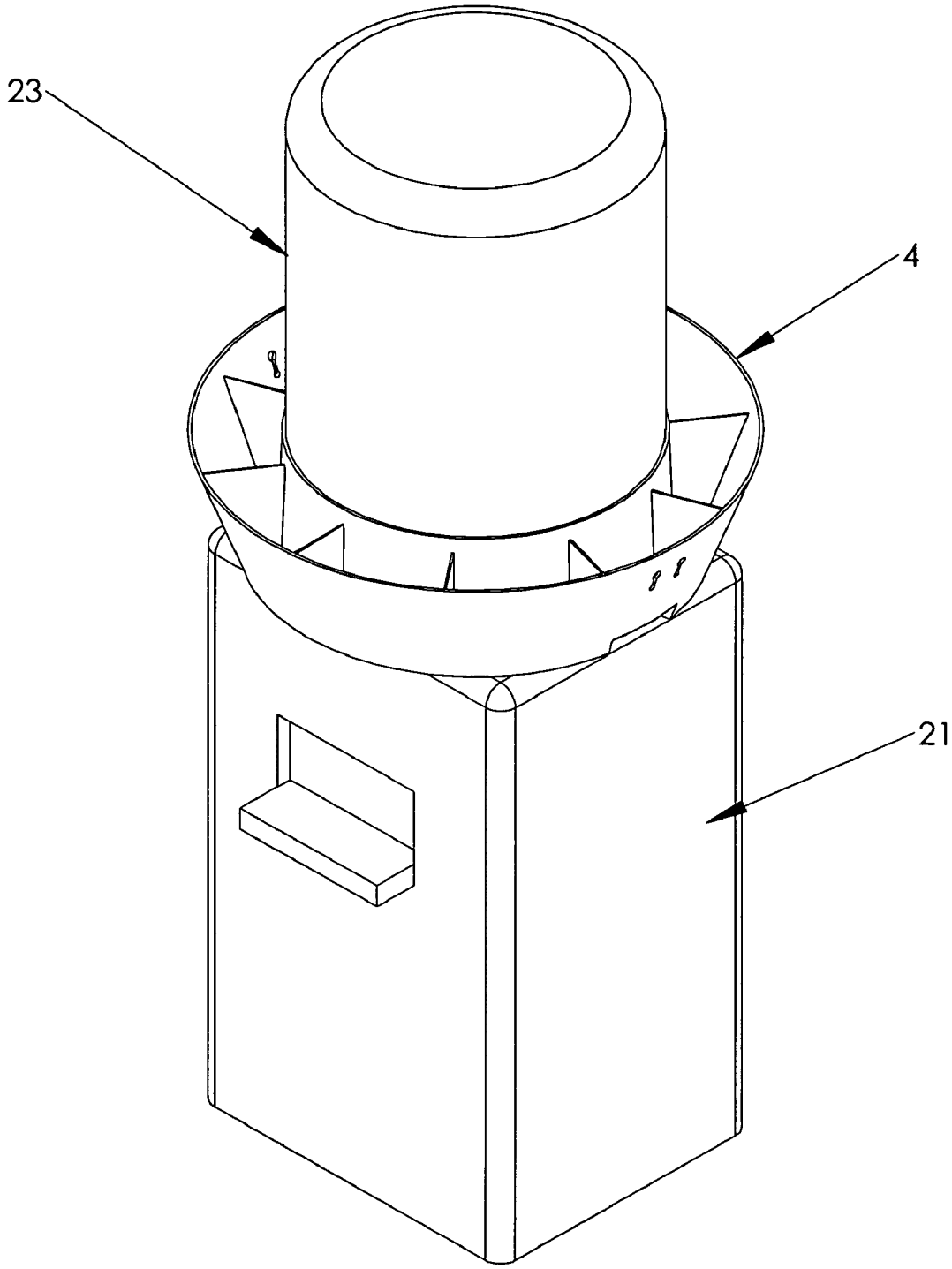
FIG. 10 is a perspective view of the water cooler caddy of FIG. 9 installed on a water cooler.

In yet another example, shown in FIG. 9, the water cooler caddy 4 has a complete annular ring without a gap in the ring. The construction and use of this example is similar to the previous examples, and only significant differences are described. The absence of a gap in the ring may serve to increase the structural rigidity of the water cooler caddy 4. In this example, the radius of curvature of the inner surface 3 may be greater than or equal to that of the water bottle 23 to which it is to be mounted. The water cooler caddy 4 is placed in an operational position with respect to the water cooler 21 by first positioning the opening in the center of the water caddy cooler 4, bounded by the inner surface 3 above the top of the water bottle 23, centering the opening in the water cooler caddy 4 with respect to the axis of the water bottle 23, and lowering the water cooler caddy 4 into the position as shown in FIG. 10. It will be appreciated by persons skilled in the art that, amongst other aspects of the previous two examples, features such as the work surface 15 and the shape of the outer surface 5 shown in FIG. 6, may be combined with the complete annular ring of the present example.

In an aspect, the water cooler caddy 4 of FIG. 9 may be sized and dimensioned such that a portion of the inner surface 3 has a radius of curvature smaller than the radius of curvature of the water bottle 23, such that when the water cooler caddy is placed on top of the water cooler 21, and the water bottle 23 subsequently installed, the water bottle 21 captivates the water cooler caddy 4 between a surface 25 of the water cooler 21 and the water bottle 23.

Figure 11:
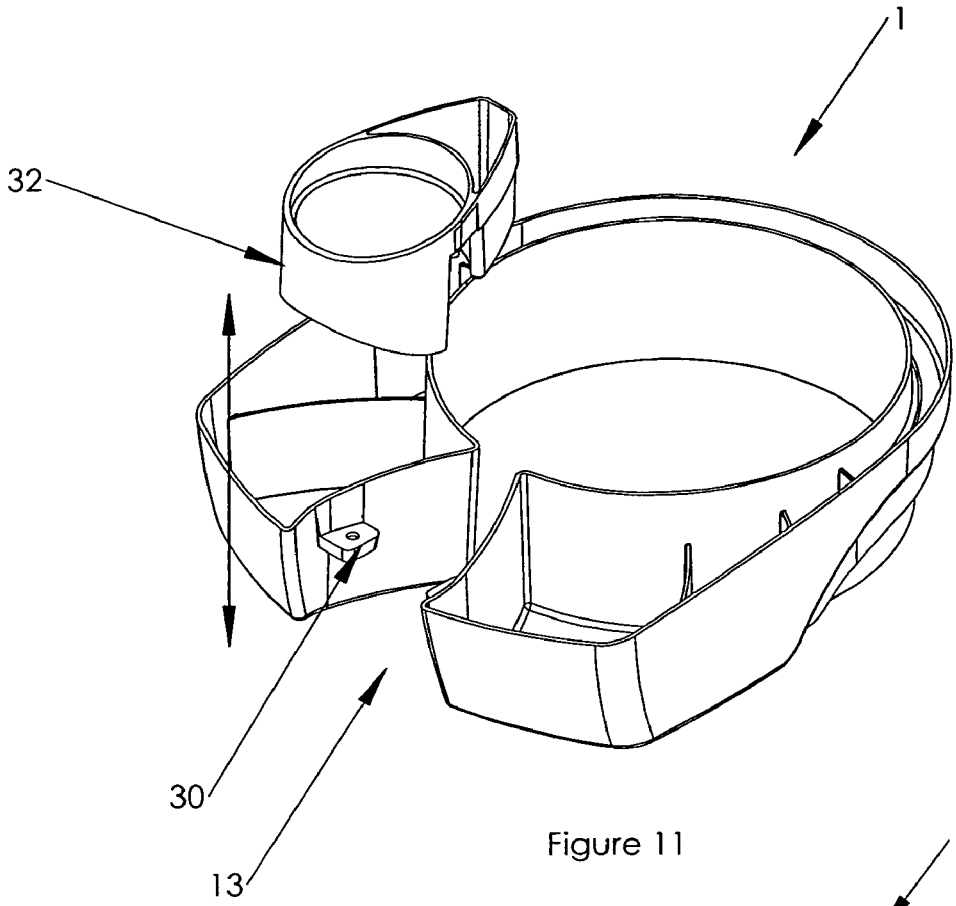
FIG. 11 is a perspective view of a further example of a water cooler caddy having a detachable fixture.

In a further example of a water cooler caddy, shown in FIG. 11, the overall construction is similar to that shown in FIG. 1, and only additional features of the configuration are discussed. The water cooler caddy 1 has a gap 13, such that it is capable of being positioned on a water bottle 23 with the gap 13 corresponding to the general position of the dispensing nozzle at the front of the water cooler 21. Flanges 32 (the second flange at the opposing side of the gap is not illustrated) are positioned, sized and dimensioned so as to be able to receive a removable fixture 32. As illustrated, the fixture is in the form of a platform upon which a cup may be set. However it may have any of the capabilities previously described, or the capabilities of a removable fixture as may be attached to the first example by the keyhole slots 19.

Figure 12:
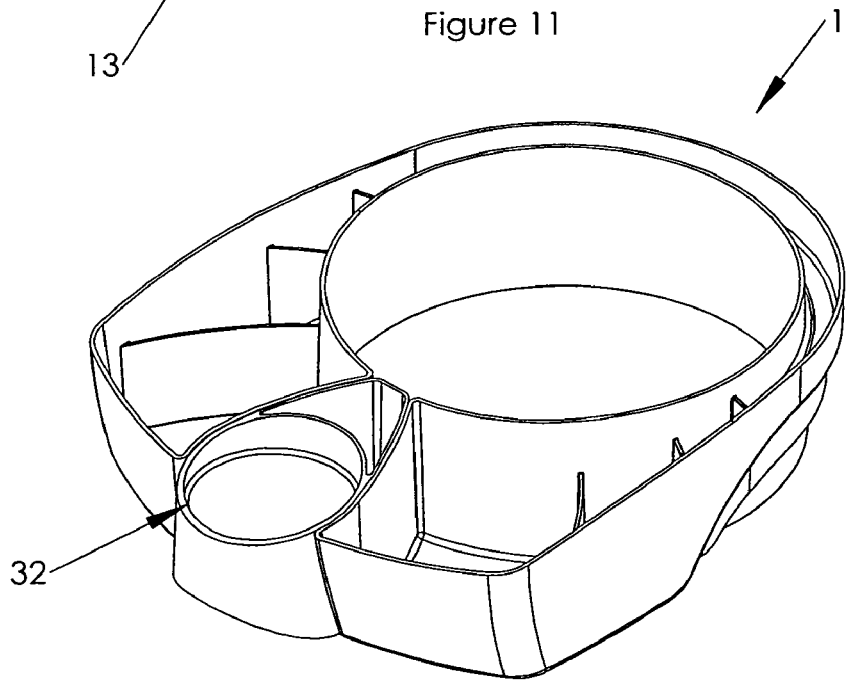
FIG. 12 is a perspective view of a further example of a water cooler caddy having a detachable fixture installed.
Figure 13:
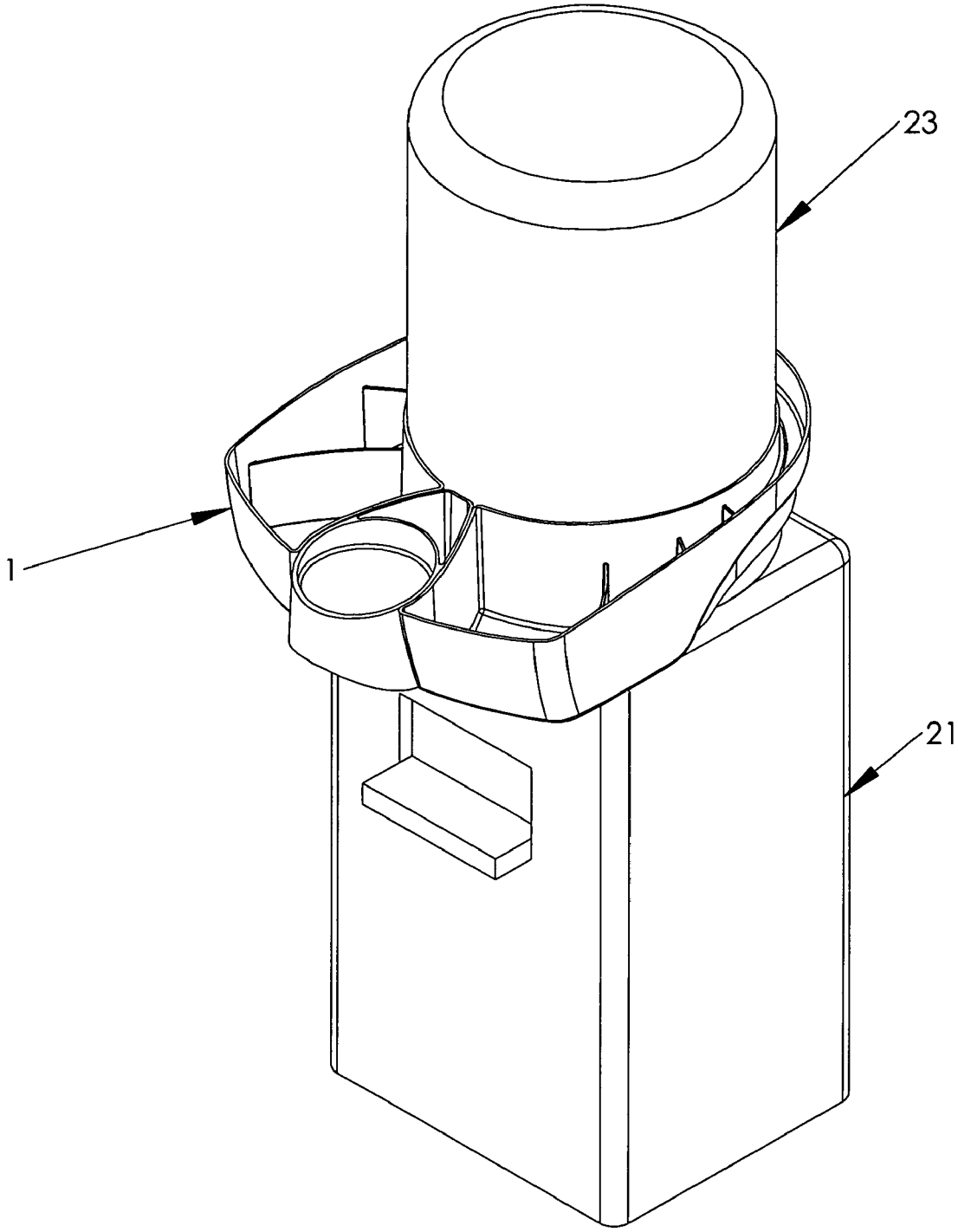
FIG. 13 is a perspective view of the water cooler caddy of FIG. 12 installed on a water cooler.

FIG. 12 shows the removable fixture 32 attached to the main body of the water cooler caddy 1 using the flanges 32, and FIG. 13 shows the water cooler caddy 1 in position with respect to the water bottle 23 on the water cooler 21.

It is therefore intended that the foregoing detailed description be regarded as illustrative rather than limiting, and that it be understood that it is the following claims, including all equivalents, that are intended to define the spirit and scope of this invention.

What is claimed is:

1. A device in combination with a water bottle, when the water bottle is inserted in an inverted position with respect to a water cooler, such that a body of the water bottle protrudes from the water cooler through a surface thereof, the device comprising:

a structure with a first arcuate surface and a second surface disposed so as to oppose the first actuate surface and having a bottom portion joining a bottom portion of the first actuate surface and a bottom portion of the second surface so as to form an annular trough extending at least half the circumference of the water bottle, and wherein the first arcuate surface and the second surface are fixedly spaced apart, and the first arcuate surface is dimensioned such that a diameter thereof is substantially equal to a diameter of the body of the water bottle, and a height of the first arcuate surface is dimensioned so that a bottom surface of the body of an inverted water bottle protrudes from the device when the device and a water bottle are mounted on the water cooler.

2. The device of claim 1, further comprising a partition extending between the side and arcuate surfaces so as to form two or more compartments.

3. The device of claim 1, wherein the arcuate surface is continuous so as to form a complete annular ring.

4. The device of claim 1, wherein the first arcuate surface and the second surface are interrupted by a gap so as to form an incomplete annular trough.

5. The device of claim 4, wherein the dimension of the gap is such that the annular ring may be spread such that the gap aperture is greater than the diameter of the water bottle.

6. The device of claim 5, wherein an end surface is formed so as to be attached to the arcuate surface, the bottom portion and the side surface.

7. The device of claim 2, wherein the partition is integrally formed with the arcuate and side surfaces and the bottom portion.

8. The device of claim 2, wherein grooves are disposed in at least one of the arcuate and side surfaces, sized and dimensioned so as to restrain the partition.

9. The device of claim 1, further comprising a work surface dimensioned so as to permit a cup to be supported thereby, disposed substantially horizontally, and attached to at least one of the arcuate surface, the bottom portion, or the side surface.

10. The device of claim 9, wherein the work surface has an aperture therein, sized and dimensioned to retain a cup.

11. The device of claim 10, wherein the aperture is sized and dimensioned to retain a cup having a conical shape.

12. The device of claim 1, wherein the diameter of the arcuate surface is greater than the diameter of the water bottle.

13. The device of claim 1, wherein the diameter of the arcuate surface is equal to the diameter of the water bottle.

14. The device of claim 1, wherein the diameter of the arcuate surface is less than the diameter of the water bottle.

15. The device of claim 1, further comprising a compressible material affixed to a surface of the arcuate surface facing the water bottle.

16. The device of claim 2, wherein a plurality of the partitions forms compartments, each compartment sized and dimensioned to hold an object or a variety of objects to be stored in the device.

17. The device of claim 1, further comprising at least two handles disposed on the side surface.

18. The device of claim 17, wherein the handles are integrally molded with the side surface.

19. The device of claim 17, where the handles are disposed such that an opposing force applied to the handles causes a gap in the arcuate surface to expand.

20. The device of claim 7, wherein the arcuate surface extends further from the bottom portion than the side surface extends from the bottom portion.

21. The device of claim 1, wherein means for attaching accessories is provided at the side surface.

22. The device of claim 1, wherein at least some of the partitions are opposing ends of a removable bin.

23. The device of claim 1, further comprising:

a fixture sized and dimensioned so as to be accommodated in a gap formed in the arcuate surface and to form a platform to support a cup.

24. The device of claim 1, wherein the structure is molded.

25. The device of claim 1, wherein the first annular surface and the second surface are fixedly spaced apart by a substantially constant distance along a substantial portion of a length of the first annular surface and a length of the second surface.

26. The device of claim 1, wherein the annular trough is dimensioned so that the device is installed by lowering the device over an upper protruding end of the body of the water bottle.

27. The device of claim 26, wherein the device is dimensioned such that the bottom portion thereof comes in contact with the surface of the water cooler through which the inverted bottle body protrudes.

28. A system, comprising:

a water cooler;

a water bottle, disposable in an inverted position and inserted into the water cooler such that at least a portion of the body of the water bottle protrudes above a top surface of the water cooler; and, a structure with an arcuate surface and having an attached bottom surface, and a side surface attached to the bottom surface, the side surface opposing the arcuate surface, such that the arcuate surface, the side surface and the bottom surface form a trough extending for a length at least half of the circumference of the water bottle body, wherein the arcuate surface is dimensioned such that a diameter thereof is substantially equal to a diameter of the body of the water bottle, and a height of the arcuate surface is dimensioned so that a bottom surface of the body of an inverted water bottle protrudes therefrom, when the structure is mounted over the water bottle and the water bottle is mounted to the water cooler.

* * * * *

UNITED STATES PATENT AND TRADEMARK OFFICE

CERTIFICATE OF CORRECTION

PATENT NO. : 7,896,037 B2
APPLICATION NO. : 11/356937
DATED : March 1, 2011
INVENTOR(S) : Keith D. Alsberg et al.

It is certified that error appears in the above-identified patent and that said Letters Patent is hereby corrected as shown below:

In the Claims

In column 6, claim 1, line 24, after "oppose the first" replace "actuate" with --arcuate--.

In column 6, claim 1, line 26, before "surface and a bottom portion" replace "actuate" with --arcuate--.

Signed and Sealed this
Tenth Day of May, 2011

David J. Kappos

David J. Kappos
*Director of the United States Patent and Trademark Office*